US006084181A

United States Patent [19]

Lilienthal, II et al.

[11] Patent Number: 6,084,181

[45] Date of Patent: Jul. 4, 2000

[54] JACKET AND CORD HAVING CIRCULAR AND NON-CIRCULAR PORTIONS, AND METHOD FOR PRODUCING THE SAME

[75] Inventors: Peter Frederick Lilienthal, II, Princeton; Troy Paul Million, Sparta, both of N.J.

[73] Assignee: Lucent Technologies, Inc., Murray Hill, N.J.

[21] Appl. No.: 09/166,310

[22] Filed: Oct. 5, 1998

[51] Int. Cl.[7] ..... H01B 7/04

[52] U.S. Cl. ..... 174/115; 174/117 R

[58] Field of Search ..... 174/115, 117 R, 174/117 F, 119 R, 102 SP, 129 R, 133 R, 68.1, 68.3, 96, 97, 98

[56] References Cited

U.S. PATENT DOCUMENTS

| | | | |
|---|---|---|---|
| 3,588,313 | 6/1971 | Broghton | 174/28 |
| 3,602,620 | 8/1971 | Fassler | 431/99 |
| 4,229,615 | 10/1980 | Orr, Jr. et al. | 174/117 F X |
| 4,439,256 | 3/1984 | Meserve | 174/117 F X |
| 4,472,598 | 9/1984 | Boyd et al. | 174/102 SP X |
| 4,638,117 | 1/1987 | Ney | 174/117 F |
| 4,837,405 | 6/1989 | Bonjour et al. | 174/115 X |
| 5,831,215 | 11/1998 | Ziemek et al. | 174/108 |

OTHER PUBLICATIONS

"110 Patch Cords, D8SA Modular Cords", Article from Lucent Technologies, Inc., 1996.

*Primary Examiner*—Hyung-Sub Sough
*Assistant Examiner*—Chau N. Nguyen
*Attorney, Agent, or Firm*—Duane Morris & Heckscher LLP; Steven E. Koffs

[57] ABSTRACT

A cord has a jacket for containing wires. The jacket has a plurality of circular portions and a plurality of non-circular portions alternating with each other. The circular portions are substantially circular, and the non-circular portions are substantially non-circular, and may be in the shape of a "C" or "U". The "C" or "U" shape maintains the wires in a predetermined order. A method for forming cord includes alternately: (a) extruding a circular portion having a cross section that is substantially circular around a plurality of wires; and (b) extruding a non-circular portion having a cross section that is substantially non-circular around the plurality of wires. The extrusion is continuous, so that the non-circular portion is adjacent to the circular portion. The non-circular portion may be opened so that the conductors are arranged substantially in a line.

8 Claims, 5 Drawing Sheets

JACKET AND CORD HAVING CIRCULAR AND NON-CIRCULAR PORTIONS, AND METHOD FOR PRODUCING THE SAME

FIELD OF THE INVENTION

The present invention relates to the field of telecommunications generally, and more specifically to cords for data and voice circuits.

DESCRIPTION OF THE RELATED ART

Cords capable of carrying voice and data are well known.

For example, Lucent Technologies, Inc. manufactures data grade 1074 cordage having 24 gauge, stranded copper conductors insulated with high density polyethylene. Typically, each conductor has a different insulation color, so the conductors may be distinguished from each other. The insulated conductors are tightly twisted into individual pairs. These cords are available in 1-, 2-, 3-, and 4-pair sizes. In the cords having more than one pair of conductors, the pairs are twisted about each other. The pairs are then jacketed with a polyvinyl chloride (PVC) jacket.

To use the cords, a connector, such as an 8-pin modular plug, is attached to an end of the cord. Because the conductors are twisted within pairs, and the pairs are twisted about each other, a visual identification has been required to determine which colored conductor should be attached to each pin of the connector.

A substantially flat cord for data and voice has been designed, in which the pairs are arranged in a fixed order within the cord. Because the order is fixed, a visual inspection is not needed to determine which conductor should be connected to each pin of the connector. The flat cord, however, has disadvantages. Because the pairs of conductors are not twisted about each other, the electrical performance of the flat cord is not the same as the conventional twisted pair cord; the flat cord is likely to be noisier. Moreover, the area moment of inertia of the flat cord is much greater in one direction than the other, so the flat cord is only easily bent around one axis, namely the axis about which the moment of inertia is smaller. It is very difficult to bend the flat cord around the other axis.

An improved cord is desired.

SUMMARY OF THE INVENTION

The present invention is a jacket for containing wires, having a plurality of circular portions and a plurality of non-circular portions alternating with each other. The circular portions are substantially circular, and the non-circular portions are substantially non-circular.

According to another aspect of the invention, a cord includes a plurality of wires within a jacket having a plurality of circular portions and a plurality of non-circular portions alternating with each other.

According to another aspect of the invention, a method for forming a jacket includes alternately: (a) forming a circular portion having a cross section that is substantially circular; and (b) forming a non-circular portion having a cross section that is substantially non-circular, the non-circular portion being adjacent to the circular portion.

According to still another aspect of the invention, a method of forming a cord includes alternately (a) forming a circular jacket portion around a plurality of substantially circular wires, and (b) forming a non-circular substantially non-circular jacket portion around the plurality of wires, adjacent to the circular jacket portion.

These and other aspects of the invention are described below with reference to the drawings and the exemplary embodiments.

BRIEF DESCRIPTION OF THE DRAWINGS

In the drawings, the cross-hatching indicates color.

DETAILED DESCRIPTION

Figure 1:
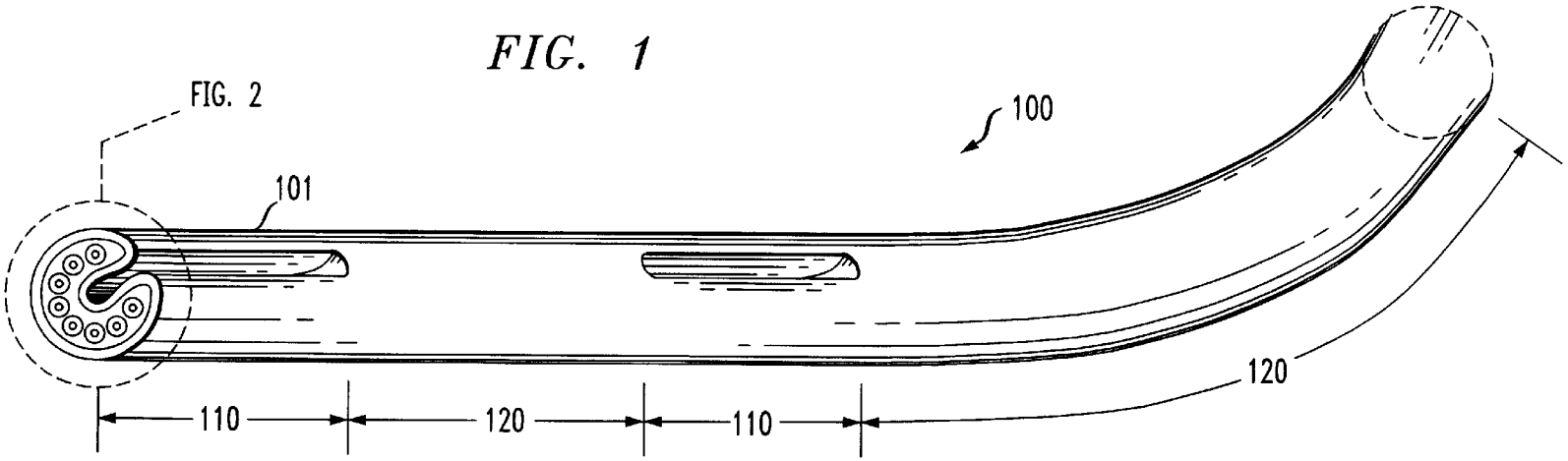
FIG. 1 is an isometric view of an exemplary cord according to the invention.
Figure 2:
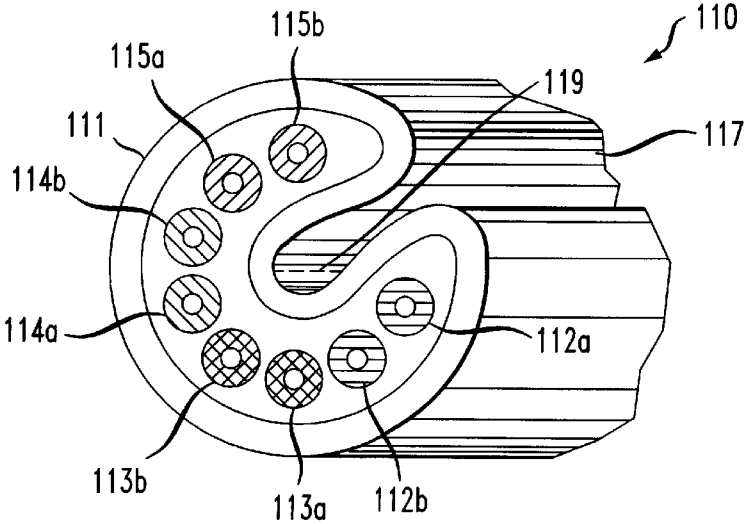
FIG. 2 is an enlarged view of the end of the cord of FIG. 1.
Figure 3:
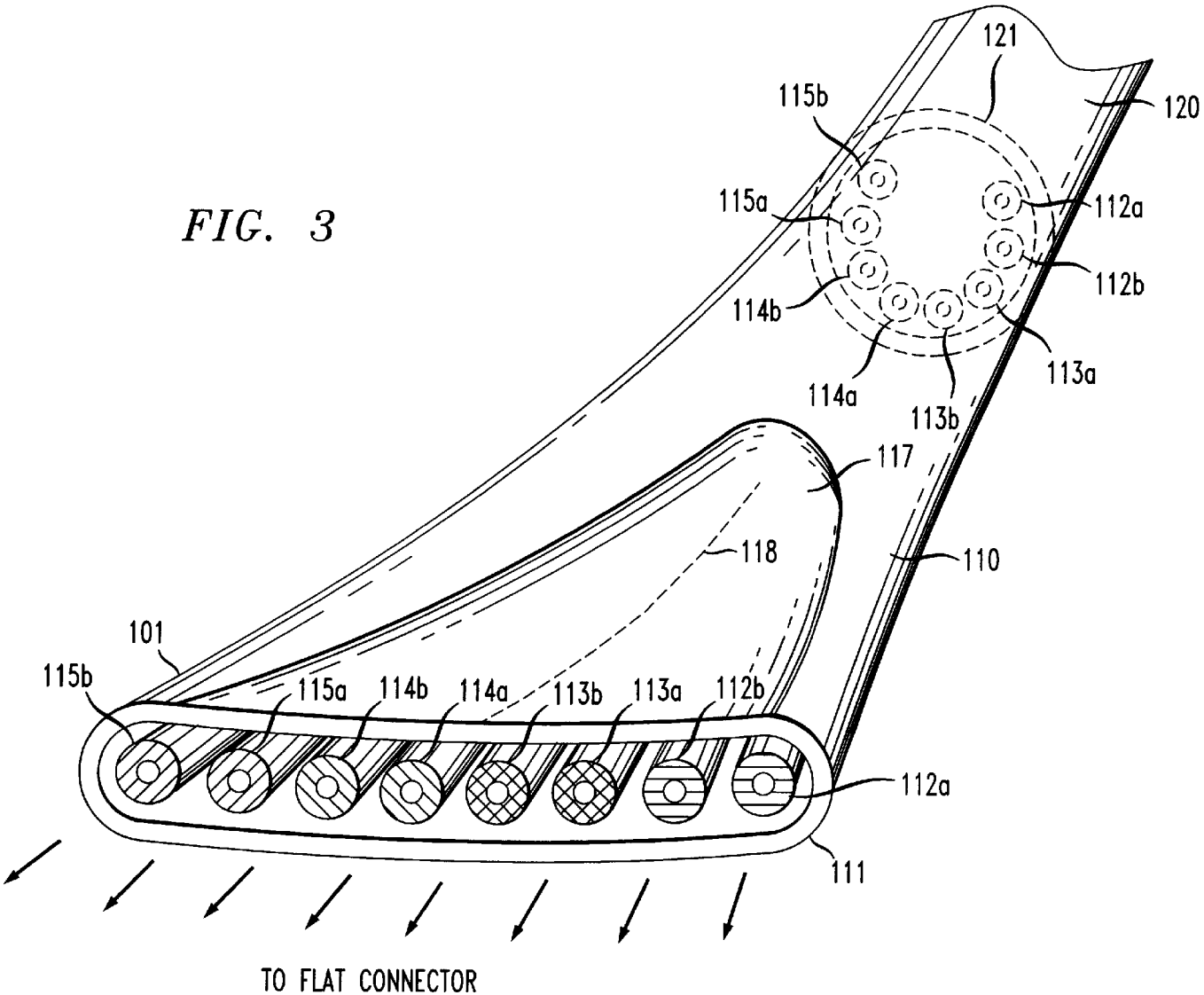
FIG. 3 is a perspective view of the end of the cord shown in FIG. 1, opened up into a substantially flat configuration. A cross section of a portion of the cord remote from the end is shown in phantom.

FIGS. 1–3 show an exemplary cord 100 having a jacket 111 according to the invention, for containing wires 112*a*–115*b*. The jacket 111 has a plurality of circular portions 120. Each circular portion 120 has a cross section that is substantially circular (as best seen in FIG. 3). The cross section of circular portion 120 is similar to the cross section of a conventional cord.

The jacket 111 also has a plurality of non-circular portions 110. Each non-circular portion 110 has a cross section that is substantially non-circular. The cross section of each non-circular portion 110 of the jacket 111 is defined by a center 119. The non-circular portions 110 have an elongated cross section (best seen in FIGS. 2 and 3) which is folded or creased, so as to have the form of a letter "C" or "U." This shape may also be referred to as a crescent or horseshoe. A crease 118 is shown. A concavity 117 is produced. The circular portions 120 and non-circular portions 110 alternate with each other, as best seen in FIG. 1. FIG. 1 also shows that at least one end portion 101 of the jacket is a non-circular portion 110.

FIG. 3 shows that the end portion 101 is capable of being opened into an approximately flat configuration, as best seen in FIG. 3. With the end portion 101 in the flat open position, the plurality of wires 112*a*–115*b* housed within the jacket 111 have respective wire ends arranged substantially in a line.

The above-described jacket 111 allows the plurality of wires to be arranged so that the ends of wires 112*a*–115*b* line up in a predetermined order within the line when the step of opening is performed. In the example, the predetermined order is blue 112*a*, light blue 112*b* orange 113*a*, light orange 113*b*, dark green 114*a*, green 114*b*, brown 115*a*, and light brown 115*b*. This predetermined order matches an order in which a plurality of terminals are arranged in a flat connector (not shown) to which the ends of wires 112*a*–115*b* are to be connected.

One of ordinary skill in the art recognizes that, so long as the wires within each individual pair of wires twists at a substantially constant number of millimeters per twist, and the pairs twist about each other at a substantially constant number of millimeters per twist, it is possible to calculate a least common multiple (LCM) distance at which the wires 112*a*–115*b* are arranged within a non-circular section 110 in the same order as the ends of the wires in end portion 101. Similarly, one of ordinary skill in the art can readily determine the order in which the wires are arranged within jacket 111 at intermediate distances (less than the LCM distance), wherein the wires 112*a*–115*b* are arranged within a non-circular section 110 in a different order than the order shown in FIG. 3.

One of the advantages of this configuration is that it allows a connector to be assembled to the cord 100 automatically, without visually inspecting the individual conductors 112*a*–115*b*. At any given non-circular portion 110 along the cord 100, the order of the conductors 112*a*–115*b* may be determined based on the twist rates within the individual pairs, and the rates at which the pairs twist about each other. A machine can mechanically locate the concavity 117. The cable 100 can then be opened automatically at that non-circular portion 110 into the flattened position (FIG. 3). Because the order of the wires 112*a*–115*b* is already determined, a machine can attach the connector to the individual conductors 112*a*–115*b* without a visual identification of the colors by a human.

According to another aspect of the exemplary embodiment, the circular portions 120 are substantially longer than the non-circular portions 110. One of ordinary skill in the art understands that the drawings are not to scale, and the distance between successive non-circular portions 120 may be much greater than the distance shown in FIG. 1. For example, the non-circular portions 110 may be about 2.5 centimeters (cm) or 1.0 inch long, and the circular portions 120 may be about 30 cm or 12 inches long. Other aspect ratios may also be used.

The circular portions 120 have about the same area moment of inertia for bending in any direction, but the non-circular 110 portions have an area moment of inertia that varies, depending on the plane about which the non-circular portion 110 is bent. Any bend about a plane with a high area moment of inertia would require more bending force than is required to bend a conventional circular cord by the same angle. Because the circular portions 120 are much longer than the non-circular portions 110, the average area moment of inertia along the length of the cord 100 is approximately the same as the area moment of inertia of a conventional cord having only a circular cross section, no matter which plane the cord 100 is bent about. Thus, cord 100 can be bent by a given angle in any direction without requiring substantially more effort than is required to bend a conventional cord having only circular cross sections by the same angle.

Figure 5B:
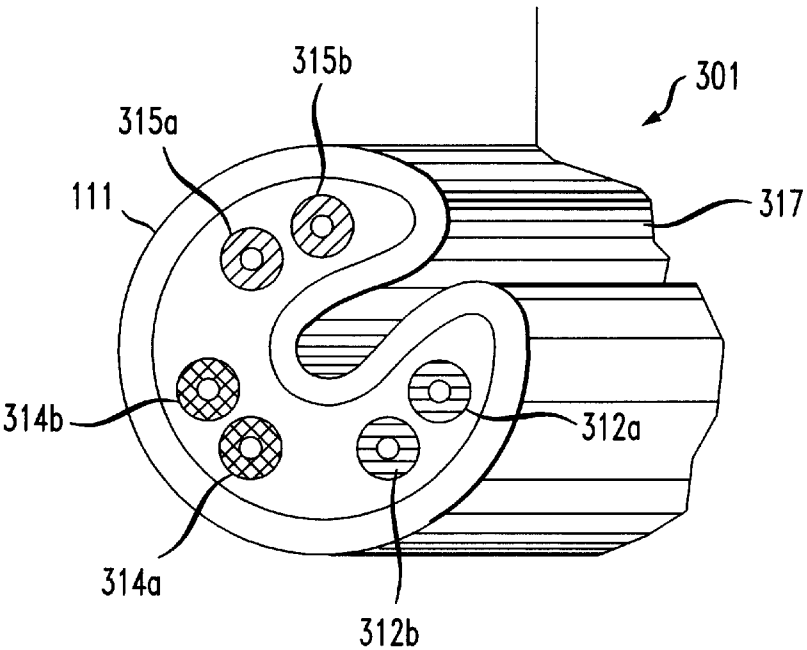
FIGS. 5A and 5B show further exemplary cords including the jacket shown in FIGS. 1–3.
Figure 5A:
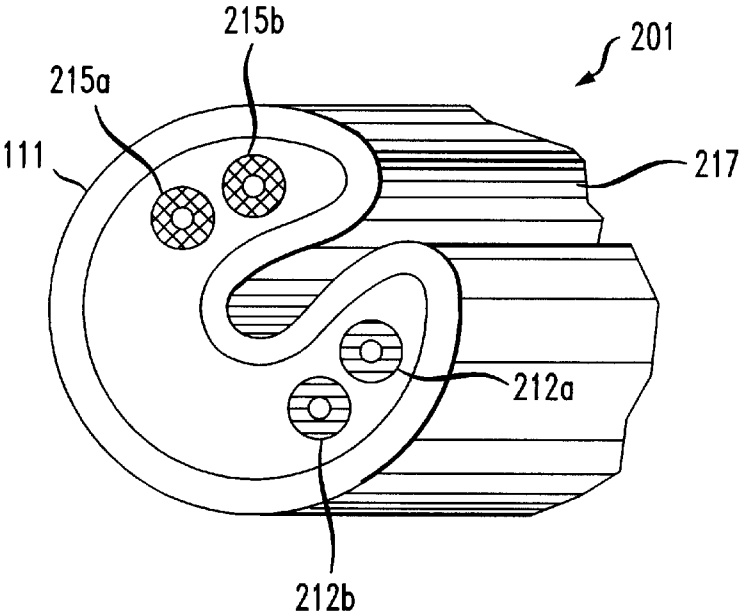

FIGS. 5A and 5B show how the same jacket 111 may be used with any number of pairs of wires. For example, the cord end 201 in FIG. 5A includes two pairs of wires, in this case blue 212*a*, light blue 212*b*, orange 215*a* and light orange 215*b*. The cord end 301 of FIG. 5B has three pairs of wires, in this case, blue 312*a*, light blue 312*b*, orange 314*a*, light orange 314*b*, green 315*a* and light green 315*b*. One of ordinary skill in the art recognizes that these are only examples. The number of pairs of wires may vary, and the colors of each individual wire and pair of wires may also vary.

The exemplary jacket and cord may be formed using the same materials that would be used for conventional cords. For example, the individual conductors may be coated with high density polyethylene. The jacket may be formed of a flame retardant PVC. Other materials may be used, as understood by one skilled in the art.

Figure 4A:
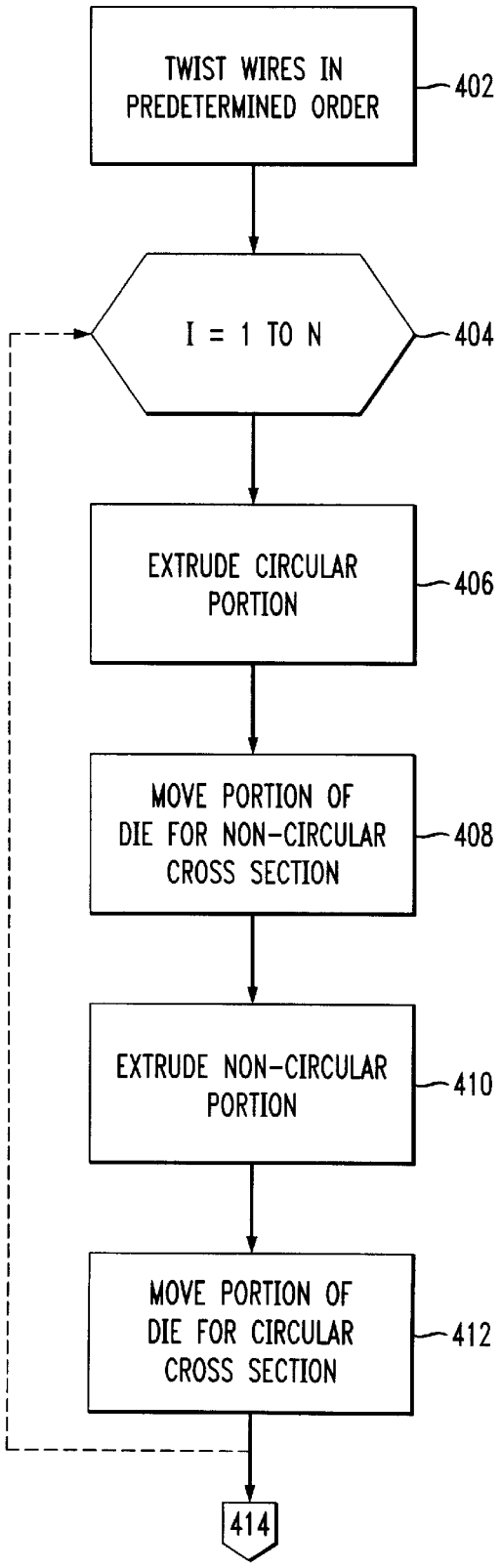
FIG. 4A is a flow chart diagram of an exemplary method of forming the cord shown in FIG. 1.

FIG. 4A is a flow chart diagram of an exemplary method for forming the jacket 111. In this example, an extruder die having a movable portion is used. With the movable portion in a first position, a circular portion 120 having a circular cross section is extruded. With the movable portion in a second position, a non-circular portion 110 having a non-circular cross section is extruded.

At step 402, the wires are formed and twisted in a conventional manner. For example, the individual conductors may be passed through a ganged extruder to form the differently colored insulation on each conductor 112*a*–115*b*. Then the wires are twisted within pairs, and the pairs are twisted about each other.

At step 404, a loop is initiated, which is repeated for each successive pair of portions 110, 120. This loop includes steps 404–412.

At step 406, a circular portion 120 having a cross section that is substantially circular is extruded.

At step 408, the movable portion of the die is moved from the first position to the second position for non-circular cross sections.

At step 410, a non-circular portion 110 having a cross section that is substantially non-circular portion is extruded adjacent to the circular portion.

At step 412, the movable portion of the die is moved from the second position back to the first position for extruding a portion having a circular cross section.

After step 412, so long as additional length of cord is to be produced, execution returns to step 404, for repeating steps 406–412. The alternating portions of the extrusion are formed as one continuous jacket (as shown in FIG. 1). When N iterations have been performed (where N is an integer corresponding to the desired length of cord), the loop ends, and execution proceeds to FIG. 4B.

Figure 4B:
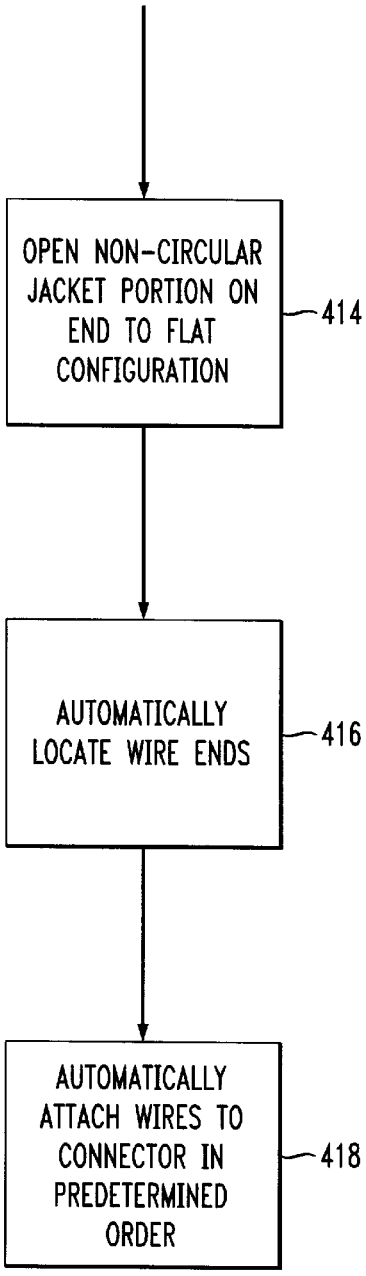
FIG. 4B is a flow chart diagram of additional steps for attaching a connector to the cord formed by the process of FIG. 4A.
Figure 4C:
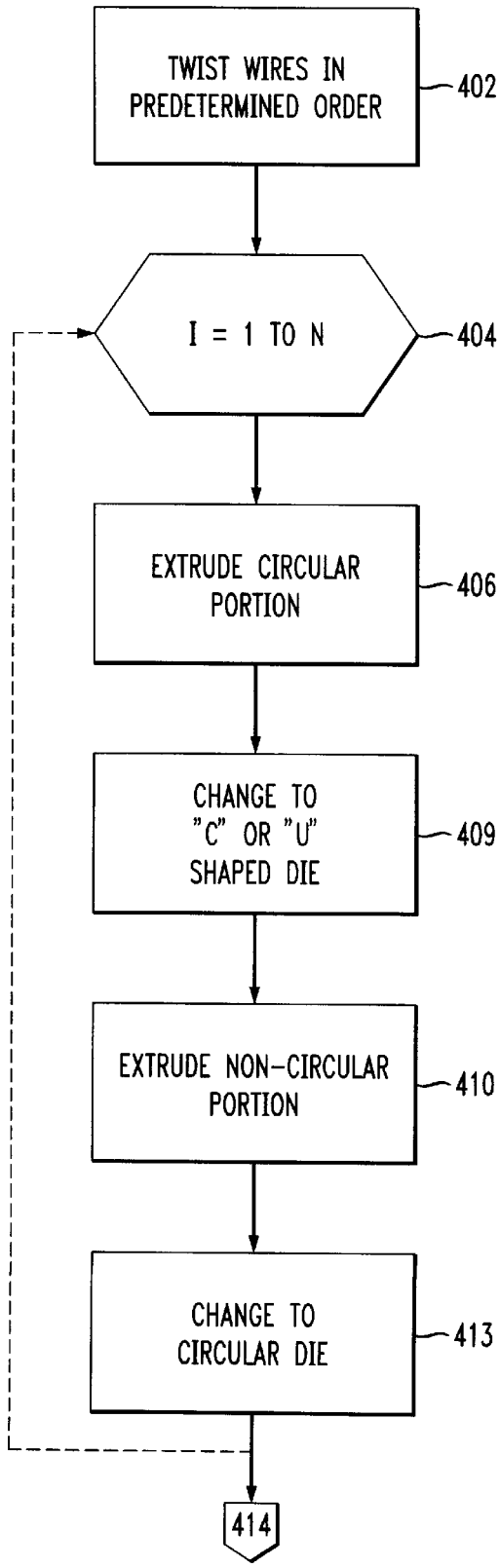
FIG. 4C is a flow chart diagram of a variation of the exemplary method shown in FIG. 4A.

FIG. 4B shows additional steps that are performed to connect the cord formed in FIG. 4A to a connector. At step 414, an end portion 101 is selected, and the non-circular portion 110 of the jacket 111 is opened to the substantially flat configuration. For example, a mechanical probe may move around the circumference of the end portion 101, until a radial movement of the probe detects the concavity 117. The cord may then be moved or rotated to a desired position for opening the non-circular portion 110.

At step 416, having positioned the cord end 101 in the desired position, the positions of each conductor 112*a*–115*b* relative to the jacket can be calculated. Similarly, the order of the wire colors is determined analytically based on the length, as described above. Then an automated tool can individually locate and grip each wire.

Depending on the length of any given cord, the order in which the wires line up at the cut end portion 101 may differ from the order in the connector. Thus, there are two significant cases to be considered: a first case in which the cord has a length at which the wire order repeats to match the connector order, and a second case in which the order of the wires at the cut (second) end differs from the order at the first end.

In the first case, in which the order repeats, assuming that the order of the colors at the first end 101 of the cord matches the order of pins in the connector, the cut (second) end of the wire (not shown) has the colors in the mirror-image order from the first end 101 (for example, from left to right, wires

112*a* to 115*b*). To attach a connector, one can merely turn the connector upside down, and the order of the cord matches the order of the connector.

In the second case, the positions of the wires are determined by analysis, and can be verified by a color recognition apparatus. For example, the order of the wires (from left to right) may be 112*a*, 112*b*, 114*a*, 114*b*, 113*a*, 113*b*, 115*a*, 115*b*. Once the position of each wire is confirmed and the end portion of the jacket 111 is cut, the ends of two or more pairs may be manipulated to position the ends in the desired order. In this example, the second and third pairs are twisted about each other, so the positions are: 112*a*, 112*b*, 113*a*, 113*b*, 114*a*, 114*b*, 115*a*, 115*b*.

At step 418, the wires are automatically connected to the connector in the desired predetermined order.

FIG. 4B shows a variation of the exemplary method of FIG. 4A. This variation uses two different dies (not shown); a first die having a substantially circular cross section for extruding a circular jacket portion, and a second die having a substantially non-circular cross section for extruding a non-circular portion. Preferably, the second portion has a cross section in the shape of a "C" or "U." Nearly all of the steps are the same, except that steps 408 and 412 are replaced by steps 409 and 413, respectively.

In step 409, the first die is removed and the second die is substituted therefor, for extruding a non-circular portion 110.

In step 413, the second die is removed and the first die is substituted therefor, for extruding a circular portion 120.

Steps 402 to 406, 410 are the same as described above with reference to FIG. 4A, and steps 414 to 418 are the same as described above with reference to FIG. 4B. For the sake of brevity, the descriptions of these steps are not repeated herein.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A jacket for containing wires, said jacket having a plurality of circular portions, each circular portion having a cross section that is substantially circular;

said jacket having a plurality of non-circular portions, each non-circular portion having a cross section that is substantially non-circular, and is arranged in the form of a "C" or "U" having a hollow extending approximately to the center thereof, said circular portions and non-circular portions alternating with each other, wherein upon terminating said jacket along one of said non-circular portions, said terminated non-circular portion is capable of being opened into an approximately flat configuration, so that said wires housed within the jacket have respective wire ends arranged substantially in a line.

2. A jacket according to claim 1, wherein the non-circular portions have an elongated cross section.

3. A jacket for containing wires, said jacket having a plurality of circular portions, each circular portion having a cross section that is substantially circular;

said jacket having a plurality of non-circular portions, each non-circular portion having a cross section that is substantially non-circular, and is arranged in the form of a "C" or "U" having a hollow extending approximately to the center thereof, said circular portions and non-circular portions alternating with each other, wherein at least one end portion of the jacket is one of said non-circular portions, and the end portion is capable of being opened into an approximately flat configuration, so that said wires housed within the jacket have respective wire ends arranged substantially in a line.

4. An electrical cord, comprising:

a jacket having a plurality of circular portions, each circular portion having a cross section that is substantially circular, said jacket having a plurality of non-circular portions, each non-circular portion having a cross section that is substantially non-circular and is arranged in the form of a "C" or "U" having a hollow extending approximately to the center thereof, said circular portions and non-circular portions alternating with each other; and a plurality of wires housed within the jacket, wherein upon terminating said jacket along one of said non-circular portions, said terminated non-circular portion is capable of being opened into an approximately flat configuration, so that said wires housed within the jacket have respective wire ends arranged substantially in a line.

5. A cord according to claim 4, wherein the non-circular portions have an elongated cross section.

6. An electrical cord, comprising:

a jacket having a plurality of circular portions, each circular portion having a cross section that is substantially circular, said jacket having a plurality of non-circular portions, each non-circular portion having a cross section that is substantially non-circular and is arranged in the form of a "C" or "U" having a hollow extending approximately to the center thereof, said circular portions and non-circular portions alternating with each other; and a plurality of wires housed within the jacket, wherein at least one end portion of the jacket is one of said non-circular portions, and the end portion is capable of being opened into an approximately flat configuration, so that the plurality of wires housed within the jacket have respective wire ends arranged substantially in a line.

7. A cord according to claim 6, wherein the plurality of wires are arranged in a predetermined order within the line.

8. A cord according to claim 7, wherein the plurality of wires consists of twisted pairs of wires.

* * * * *